US010533274B2

(12) United States Patent
Prushinskiy et al.

(10) Patent No.: US 10,533,274 B2
(45) Date of Patent: Jan. 14, 2020

(54) WASHING MACHINE

(71) Applicant: SAMSUNG ELECTRONICS CO., LTD., Suwon-si, Gyeonggi-do (KR)

(72) Inventors: Valeriy Prushinskiy, Hwaseong-si (KR); Oleg Feygenson, Hwaseong-si (KR); Igor Ivanov, Suwon-si (KR); Jee Su Park, Hwaseong-si (KR); Jung Su Ha, Osan-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 171 days.

(21) Appl. No.: 15/716,938

(22) Filed: Sep. 27, 2017

(65) Prior Publication Data

US 2018/0100262 A1 Apr. 12, 2018

(30) Foreign Application Priority Data

Oct. 10, 2016 (KR) ..... 10-2016-0130646

(51) Int. Cl.

| | |
|---|---|
| ***D06F 37/26*** | (2006.01) |
| ***D06F 35/00*** | (2006.01) |
| ***D06F 39/02*** | (2006.01) |
| ***D06F 39/08*** | (2006.01) |

(52) U.S. Cl.

CPC ..... *D06F 37/267* (2013.01); *D06F 35/005* (2013.01); *D06F 39/02* (2013.01); *D06F 39/08* (2013.01)

(58) Field of Classification Search

None

See application file for complete search history.

(56) References Cited

U.S. PATENT DOCUMENTS

| | | | | |
|---|---|---|---|---|
| 2007/0151312 | A1* | 7/2007 | Bruce | D06F 58/203 68/3 R |
| 2010/0005681 | A1* | 1/2010 | Jo | D06F 25/00 34/215 |
| 2015/0082552 | A1 | 3/2015 | Berglund et al. | |
| 2015/0135777 | A1 | 5/2015 | Cho | |
| 2015/0211167 | A1 | 7/2015 | Kim et al. | |

FOREIGN PATENT DOCUMENTS

| | | |
|---|---|---|
| CN | 203429437 | 2/2014 |
| CN | 105442245 | 3/2016 |
| WO | 2010/0066426 | 6/2010 |
| WO | WO 2012/159679 | 11/2012 |

OTHER PUBLICATIONS

Search Report dated Jan. 24, 2018 in counterpart International Patent Application No. PCT/KR2017/010996.

Hankyung Business, "Washing machine without electricity and water," Mar. 6, 2012, http://news.naver.com/main/read.nhn?mode=LSD&mid=sec&sid1=001&oid=050&aid=0000023849); 3 pages.

* cited by examiner

*Primary Examiner* — Rita P Adhlakha

(74) *Attorney, Agent, or Firm* — Nixon & Vanderhye, P.C.

(57) ABSTRACT

Disclosed herein is a washing machine having a tub, a screen provided inside the tub to support laundry, a nozzle assembly having a plurality of washing medium spraying nozzles configured to spray washing medium toward the laundry and being movable, a driver configured to move the nozzle assembly, and a washing medium supply configured to supply the washing medium to the nozzle assembly. The washing machine may efficiently perform anhydrous washing when dry ice snow or liquefied nitrogen is used as a washing medium.

15 Claims, 14 Drawing Sheets

WASHING MACHINE

CROSS-REFERENCE TO RELATED APPLICATION

This application is based on and claims priority under 35 U.S.C. § 119 to Korean Patent Application No. 10-2016-0130646, filed on Oct. 10, 2016 in the Korean Intellectual Property Office, the disclosure of which is incorporated by reference herein in its entirety.

BACKGROUND

1. Field

The present disclosure relates generally to a washing machine capable of effectively performing an anhydrous washing.

2. Description of Related Art

Generally, a washing machine uses water as a washing medium. A washing machine washes laundry using a water stream generated by rotating a pulsator, or by the force of falling impact of laundry during rotation of the drum.

Such conventional washing machines require excessive use of water and energy consumption, and are not environmentally friendly because they often use various chemicals such as detergents, fabric softeners, and bleaches together with the water.

Accordingly, in recent years, studies have been conducted on washing methods using washing media other than or in place of water, for example, carbon dioxide, water vapor, gas, ultraviolet rays, and the like. In particular, carbon dioxide has many advantages as a non-toxic, non-flammable, ecologically acceptable, low cost, and easily obtainable laundry medium.

Dry ice snow (carbon dioxide in snow phase) obtained by adiabatically expanding liquefied carbon dioxide has a property of being easily sublimated at atmospheric pressure and room temperature. By using this property, there is a cleaning method, in which dry ice snow is sprayed onto an object to remove dirt adhering to the object through a chemical reaction occurring during sublimation.

To effectively apply the cleaning method using the sublimation of dry ice snow to the washing machine, a need exists for a structure capable of uniformly spraying the dry ice snow over the entire laundry.

SUMMARY

It is an example aspect of the present disclosure to provide a washing machine capable of performing effective washing using a washing medium other than water.

It is another example aspect of the present disclosure to provide a scanner-type washing machine.

In accordance with an example aspect of the present disclosure, a washing machine includes a tub; a screen disposed inside the tub to support laundry; a nozzle assembly comprising a plurality of washing medium spraying nozzles arranged to spray washing medium toward the laundry, the nozzle assembly configured to be movable; a driving unit configured to move the nozzle assembly; and a washing medium supply unit configured to supply the washing medium to the nozzle assembly.

The screen may have a mesh shape to allow the washing medium to pass therethrough.

The screen may include a bottom screen and a top screen, and the laundry may be inserted and fixed between the bottom screen and the top screen.

The top screen may be configured to pivot on a hinge axis to place or remove the laundry from between the bottom screen and the top screen.

The nozzle assembly may be configured to reciprocate linearly.

The plurality of washing medium spraying nozzles may be arranged along a first direction, and the nozzle assembly may be movable along a second direction orthogonal to the first direction.

The washing medium spaying nozzle may include an upper spraying nozzle provided on the upper side of the screen and a lower spraying nozzle provided on the lower side of the screen The washing medium may include carbon dioxide in snow phase.

The washing medium may include liquid nitrogen.

The washing medium may include washing water or steam.

The washing medium may include ultrasonic waves.

The nozzle assembly may further include a hot air spraying nozzle configured to spray hot air to dry the laundry.

The nozzle assembly may further include a suction nozzle configured to suck in moisture to dry the laundry.

The washing machine may further include a drain unit configured to drain washing water stored in the tub.

The washing machine may further include another tub provided under the tub and a drum rotatably installed in the another tub to wash the laundry.

In accordance with another example aspect of the present disclosure, a washing machine includes a screen provided to support laundry; a nozzle assembly including a plurality of spraying nozzles configured to spray carbon dioxide in a snow phase toward the laundry, the nozzle assembly being movable; a driving unit configured to move the nozzle assembly; and a carbon dioxide supply unit configured to supply carbon dioxide in a snow phase to the nozzle assembly.

In accordance with still another example aspect of the present disclosure, a washing machine may include a rotatable drum configured to agitate laundry, the drum having a cylindrical shape with front opening and rear opening; a back plate provided on the rear opening of the drum; and a spraying nozzle provided on the back plate and configured to spray carbon dioxide in a snow phase toward the laundry.

The back plate may be fixed.

The spraying nozzle may include a plurality of spraying nozzles that are different in spaying direction from each other.

The washing machine may further include a carbon dioxide supply unit configured to supply carbon dioxide in a snow phase to the spraying nozzle and an exhaust unit configured to exhaust carbon dioxide sublimated in the drum to the outside of the drum.

BRIEF DESCRIPTION OF THE DRAWINGS

These and/or other aspects, features and attendant advantages of the present disclosure will become apparent and more readily appreciated from the following detailed description, taken in conjunction with the accompanying drawings, in which like reference numerals refer to like elements, and wherein.

DETAILED DESCRIPTION

Figure 1:
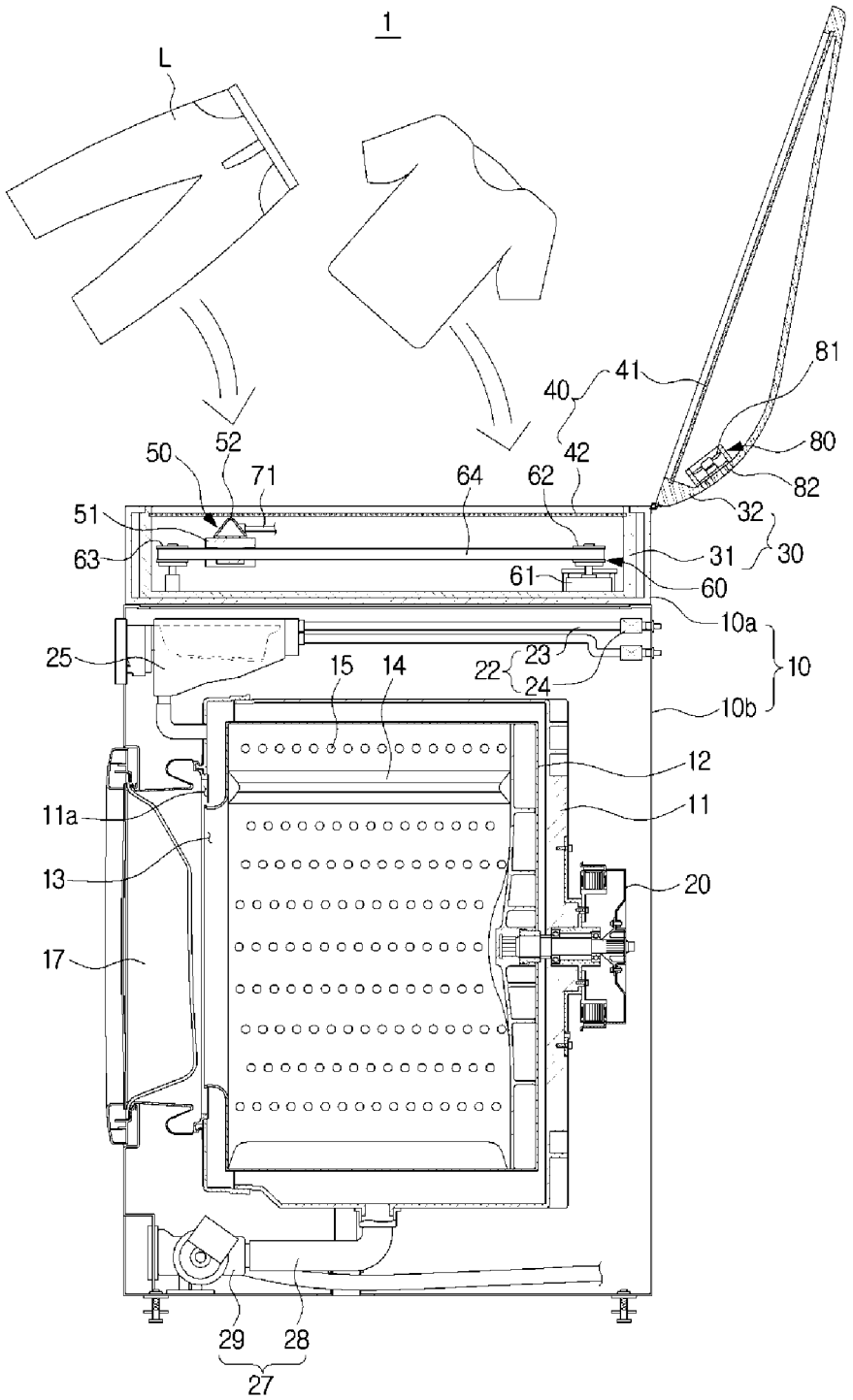
FIG. 1 is a diagram illustrating an example washing machine using dry ice snow as a washing medium with laundry being thrown into the tub, according to a first example embodiment of the present disclosure.

The various example embodiments described herein are merely example embodiments of the present disclosure and are not intended to represent all of the technical ideas of the present disclosure, so it should be understood that various equivalents or modifications that may be substituted for the same at the time of filing of the application are also included in the scope of the present disclosure.

Reference will now be made in detail to the example embodiments of the present disclosure, examples of which are illustrated in the accompanying drawings, wherein like reference numerals refer to like elements throughout.

Figure 2:
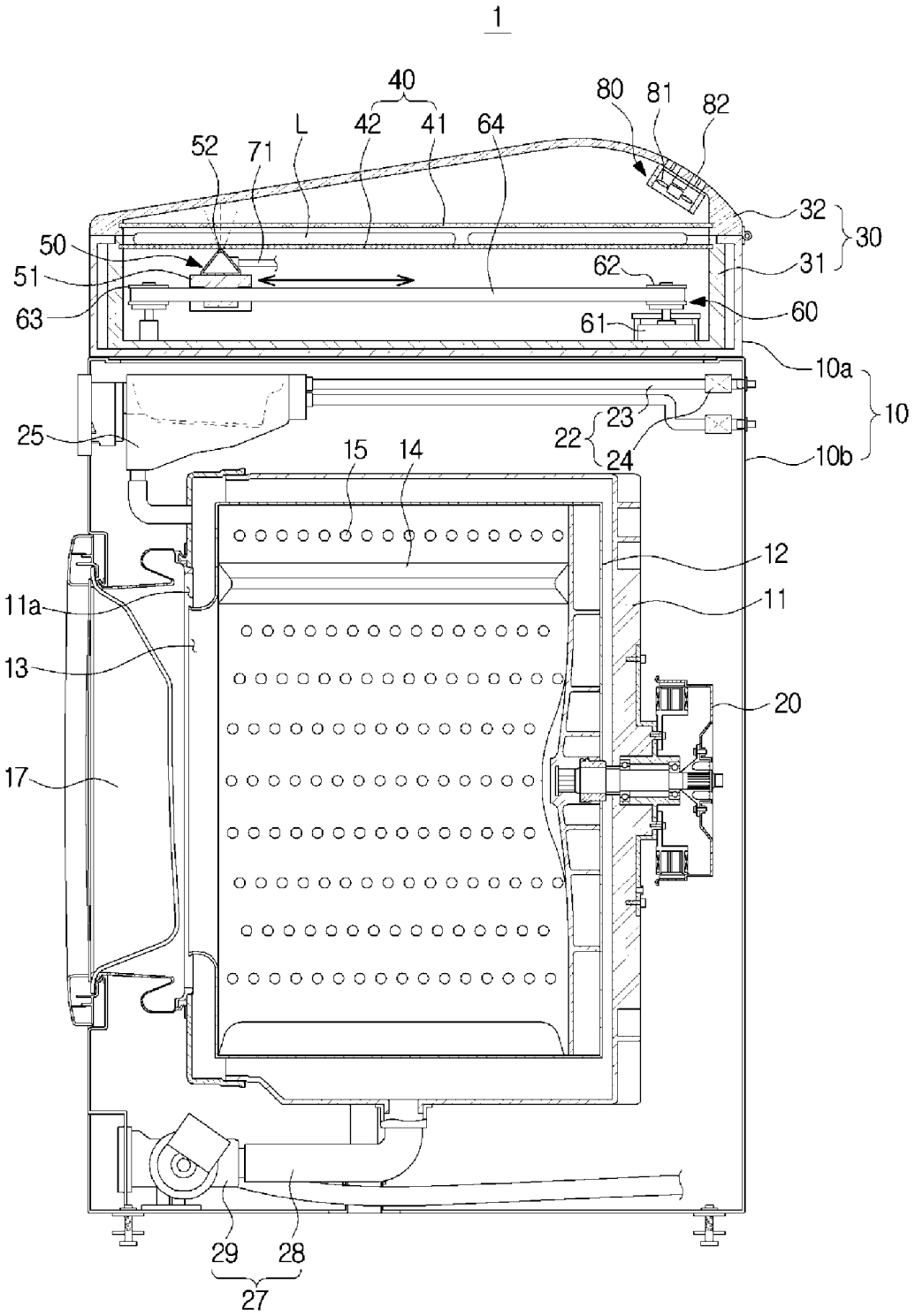
FIG. 2 is a diagram illustrating an example state in which a tub cover is closed after laundry is put into the tub of the washing machine of FIG. 1.
Figure 3:
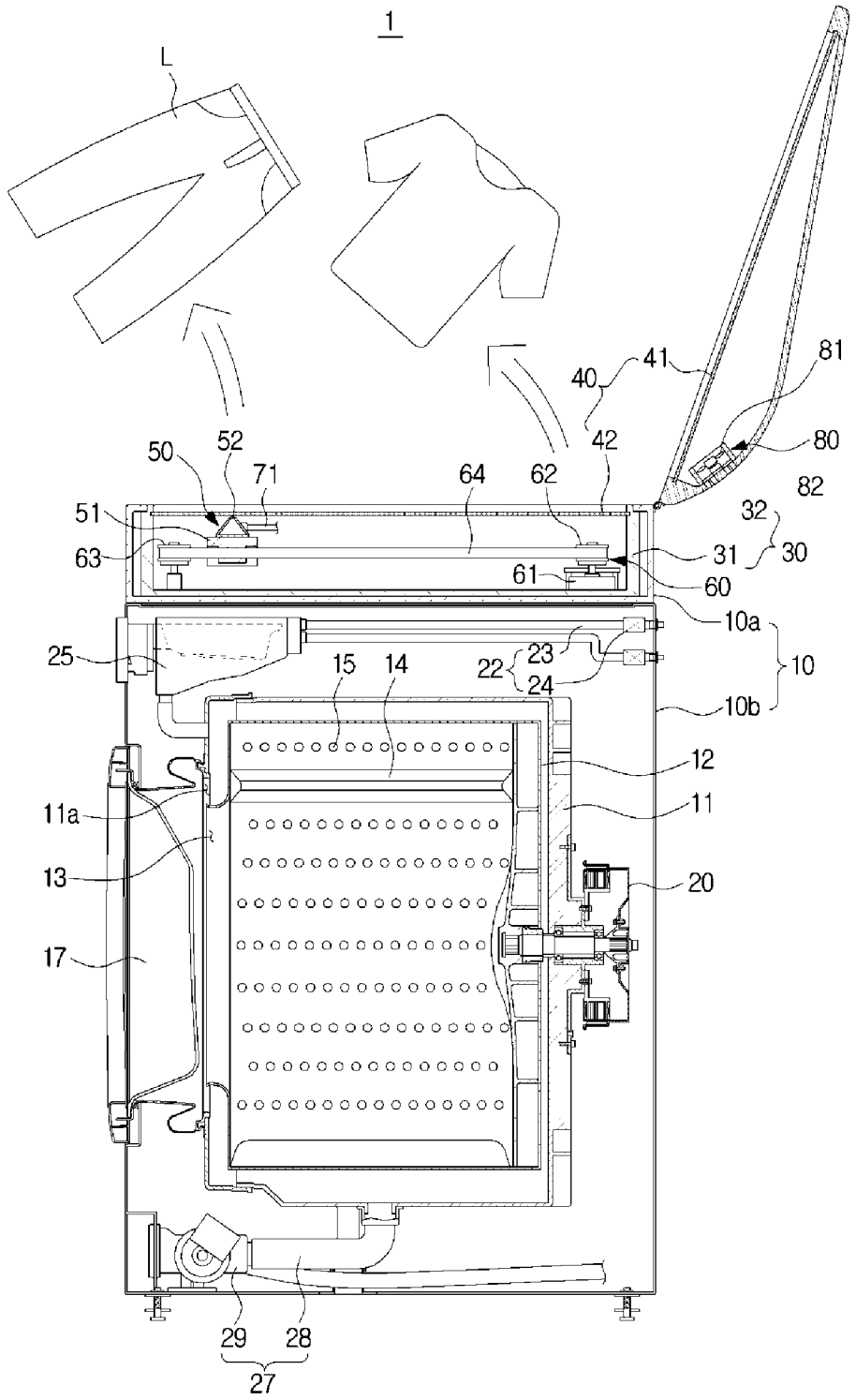
FIG. 3 is a diagram illustrating an example operation of taking laundry out after the washing machine of FIG. 1 finishes washing.
Figure 4:
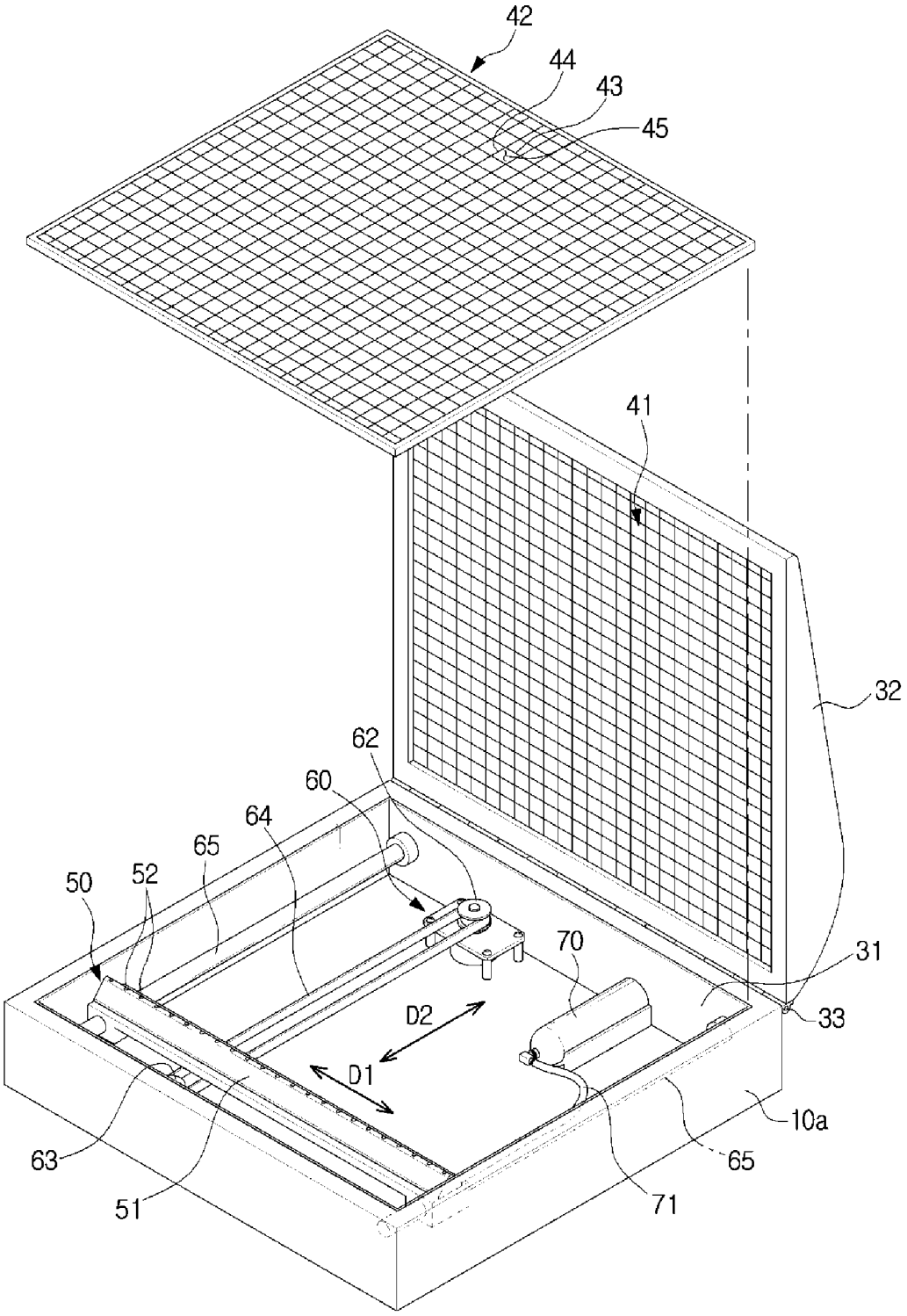
FIG. 4 is a perspective view illustrating an example configuration of the washing machine of FIG. 1.
Figure 5:
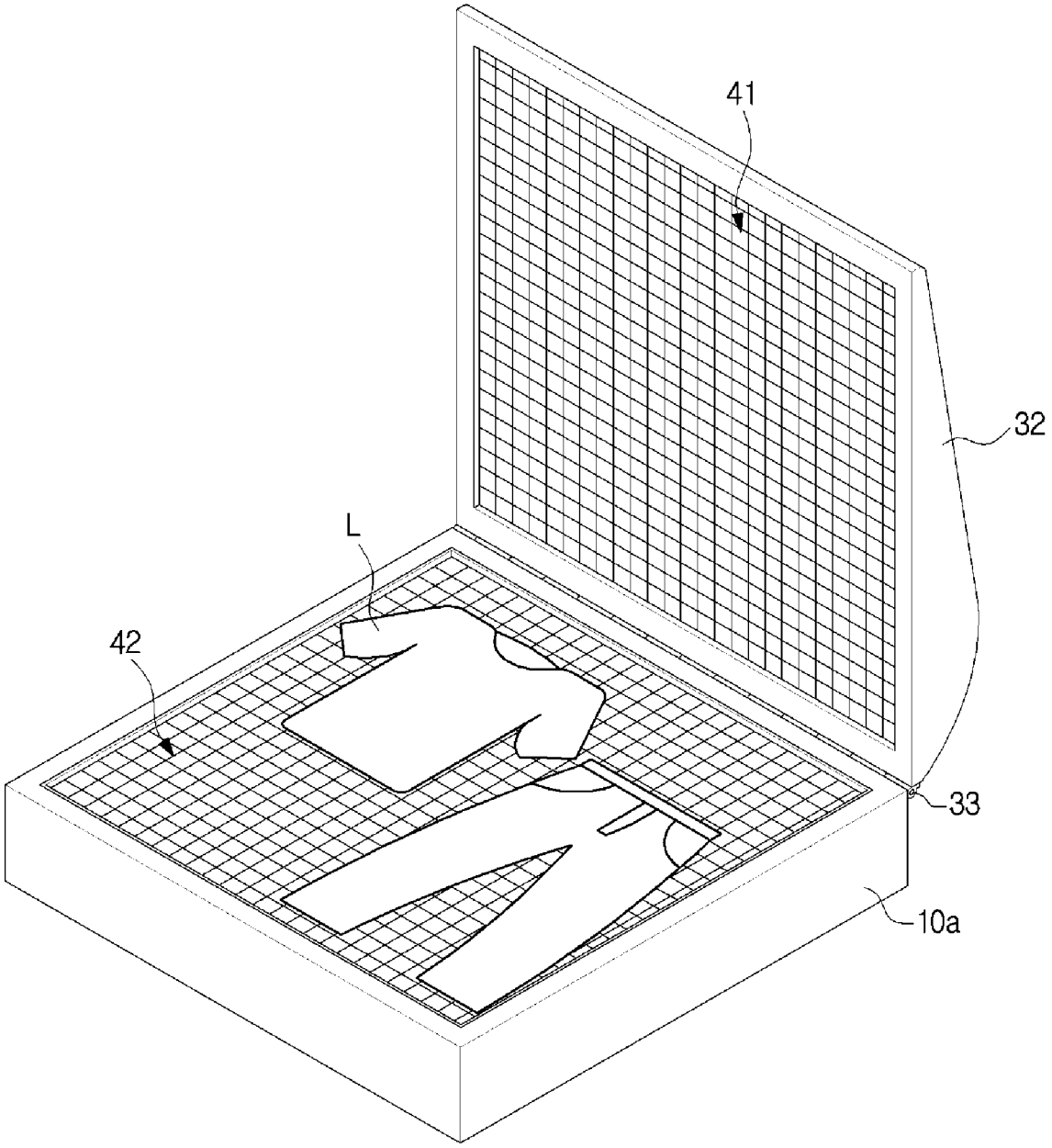
FIG. 5 is a perspective view illustrating an example state in which laundry is placed on the screen of the washing machine of FIG. 1.

FIG. 1 is a diagram illustrating an example washing machine using dry ice snow as a washing medium, with laundry being thrown into the tub, according to a first example embodiment of the present disclosure. FIG. 2 is a diagram illustrating an example state in which a tub cover is closed after laundry is put into the tub of the washing machine of FIG. 1. FIG. 3 is a diagram illustrating an example operation of taking laundry out after the washing machine of FIG. 1 finishes washing. FIG. 4 is a perspective view illustrating an example configuration of the washing machine of FIG. 1. FIG. 5 is a perspective view illustrating an example state in which laundry is placed on the screen of the washing machine of FIG. 1.

Referring to FIGS. 1 to 5, a washing machine 1 according to a first example embodiment of the present disclosure may include a main body 10, a lower tub 11 having a first washing space, an upper tub 30 having a second washing space. In other words, the washing machine 1 has a plurality of washing spaces, and the plurality of washing spaces may be independently opened and closed, and may each independently perform washing.

The washing machine 1 may use the first washing space only, the second washing space only, or both the first washing space and the second washing space at the same time.

The main body 10 may include a lower main body 10*b* to receive the lower tub 11 and an upper main body 10*a* to receive the upper tub 30. The lower main body 10*b* and the upper main body 10*a* may be integrally formed or may be separately provided and assembled with each other. Alternatively, the washing machine 1 may only include the upper tub 30, unlike the present example embodiment.

The structure of lower part of the washing machine 1 may be similar to a conventional front-loading type drum washing machine. That is, the tub 11 is provided to store water for washing, and the drum 12 may be installed inside the tub 11 to receive laundry and rotate.

The tub 11 and the drum 12 have openings 11*a* and 13, respectively, at the front and the laundry may be put into the drum 12 through the openings 11*a* and 13. A door 17 may be pivotally coupled to the main body 10 to open and close the openings 11*a* and 13.

The drum 12 may have a cylindrical shape and may be rotated by receiving rotational force from a motor 20. A lifter 14 may be formed on the inner circumferential surface of the drum 12 to lift the laundry and drop it, thereby agitating the laundry and applying impact to the laundry.

Through holes 15 may be formed in the drum 12 to allow the washing water stored in the tub 11 to flow. The drum 12 may have a sufficient size to handle large-sized laundry such as a coat or bedding or a large amount of laundry.

The washing machine 1 may include a water supply device 22 to supply washing water to the tub 11. The water supply device 22 may include a water supply pipe 23 connected to an external water supply source such as a tap and a water supply valve 24 provided in the water supply pipe 23 to control the supply of washing water through the water supply pipe 23. The water supply pipe 23 may be connected to a detergent dispenser 25 capable of supplying various kinds of detergents such as a fabric softening agent, a bleaching agent and the like.

The washing machine 1 may include a drain device 27 to drain the washing water stored in the tub 11 to the outside of the main body 10 after the washing cycle is completed. The drain device 27 may include a drain pipe 28 to guide the wash water of the tub 11 to the outside of the main body 10 and a drain pump 29 to pump the washing water of the tub 11.

With this structure, washing may be performed by opening the door 17, putting the laundry into the drum 12, putting washing water and detergent into the tub 11, and driving the drum 12 to rotate. The lower tub 11 may handle large-sized laundry or a large amount of laundry.

Unlike the lower tub 11, the upper tub 30 of the washing machine 1 may be used to wash a relatively small amount of laundry having a small size briefly and quickly. Therefore, to handle the laundry having a relatively small volume and a small size, the upper tub 30 may be used without using the lower tub 11, thereby saving washing water and energy.

Furthermore, if different textures or colors of laundry need to be washed, separate washing is performed by washing some of the laundry using the lower tub 11 while washing others using the upper tub 30. Accordingly, washing efficiency and satisfaction may be improved and damage to clothing may be avoided.

In addition, the upper tub 30 of the washing machine according to the first example embodiment of the present disclosure may use a carbon dioxide in snow phase (also referred to as dry ice snow) as a washing medium instead of the washing water, thereby further saving water and energy, doing laundry in a shorter period of time, and achieving environmentally friendly washing from not using any detergent or the like.

The tub 30 may include a tub body 31 having an opened upper surface and a tub cover 32 provided to open and close the opened upper surface of the tub body 31. The tub cover 32 may be pivotally coupled to the main body 10 or the tub body 31 on the hinge shaft 33 (see, e.g., FIGS. 4 and 5). With this structure, the laundry may be put into the tub 30 in a top loading manner.

Inside the tub 30, a screen 40 to support the laundry and a nozzle assembly 50 to spray dry ice toward the laundry supported on the screen 40 may be provided.

Dry ice is a solid form of carbon dioxide, which may be obtained by compressing carbon dioxide at high pressure and high temperature, and is a highly reactive substance that sublimates into gas at atmospheric pressure and room temperature. In the washing machine according to the first example embodiment of the present disclosure, dry ice is sprayed toward the laundry so that dirt such as stains, oil, etc., may be separated from the laundry by the physical force with which dry ice collides with the surface of the laundry and the chemical reaction with the substances stuck to the laundry caused by the sublimation of dry ice.

At this time, the dry ice is preferably in the form of snow particles before being compressed into a pellet form. Dry ice snow may, for example, be formed by adiabatic expansion of liquefied carbon dioxide gas and is so much softer than dry ice pellets that it may not damage the laundry.

For example, when the laundry is washed by spraying the dry ice snow, the effect of the washing is influenced by whether the dry ice snow is evenly sprayed to the entire laundry. The washing machine according to the first example embodiment of the present disclosure first spreads laundry to be supported on the screen 40 so that the dry ice snow may be evenly sprayed on the entire laundry.

The screen 40 includes a bottom screen 42 and a top screen 41, and is provided for the laundry to be spread and fixed between the bottom screen 42 and the top screen 41. The bottom screen 42 and the top screen 41 each have a mesh shape with horizontal lines 43 and vertical lines 44. And holes 45 are formed between the horizontal lines 43 and the vertical lines 44 so that the dry ice sprayed from the nozzle assembly 50 may pass through.

The bottom screen 42 may be mounted on the tub body 31 and the top screen 41 may be mounted on the tub cover 32. Accordingly, when the tub cover 32 is opened by pivoting on the hinge shaft 33, the top screen 41 pivots together with the tub cover 32 so that the laundry may be placed on the bottom screen 42.

When the laundry is spread on the bottom screen 42 and then the tub cover 32 is closed, the top screen 41 may pressurize the laundry placed on the bottom screen 42 to spread non-spread portions. In addition, the laundry may be maintained as is, without being moved, even under the spraying pressure of the dry ice snow.

The nozzle assembly 50 may include a nozzle body 51 and a dry ice spraying nozzle 52 provided in the nozzle body 51 to spray the dry ice snow. The nozzle assembly 50 may be arranged under the bottom screen 42 for spraying dry ice upwards.

The nozzle body 51 may be formed to extend in a direction D1 and a plurality of dry ice spraying nozzles 52 may be provided. The dry ice spraying nozzles 52 may be arranged from one side wall to the opposite side wall of the tub 30 along the direction D1.

The nozzle assembly 50 may be provided to be movable in the tub 30 so as to uniformly spray dry ice snow over the entire laundry. In particular, the nozzle assembly 50 may be arranged to make a linear reciprocating motion in a direction D2 perpendicular to the direction D1 in which the dry ice spraying nozzles 52 are arranged.

As described above, the laundry is widely spread by the screen 40, since a plurality of dry ice spraying nozzles 52 are arranged along one direction, and the nozzle assembly 50 linearly moves in a direction orthogonal to the one direction, dry ice snow may be sprayed evenly to the entire laundry without any missing parts.

Alternatively, unlike the linear reciprocating structure of the present embodiment, the nozzle assembly 50 may be provided to rotate about one point.

The washing machine 1 may include a driving unit 60 to move the nozzle assembly 50. The driving unit 60 may include a motor 61 to convert an electric force into a mechanical rotational force through electromagnetic induction, a driving pulley 62 connected to the motor 61 to rotate, a driven pulley 63 for idle rotation, and a belt 64 wound around the driving pulley 62 and the driven pulley 63 and having a fixed portion (not shown) fixed to the nozzle assembly 50. The motor 61 may cause the nozzle assembly 50 to reciprocate linearly while rotating in the forward and reverse directions.

However, it is needless to say that the drive unit 60 is not limited to such pulley and belt structures, but various known power transmission structures such as, for example, and without limitation, a rack pinion structure, a linear guide structure, and a gear structure, or the like, may be employed. The washing machine 1 may include a rail 65 to guide the movement of the nozzle assembly 50.

The washing machine 1 may include a carbon dioxide supplying unit 70, which is a washing medium supplying unit to supply the washing medium to the nozzle assembly 50. The carbon dioxide supply unit 70 may be a high-pressure cylinder in which liquid carbon dioxide is compressed and stored. The liquid carbon dioxide may be supplied to the nozzle assembly 50 through the tube 71 and changed to dry ice snow particles in the dry ice spraying nozzle 52 and sprayed. The carbon dioxide cylinder may be provided to be replaceable after all of the stored carbon dioxide is exhausted.

The sublimated carbon dioxide and the dirt removed from the laundry remain in the air inside the tub 30. The washing machine 1 may include an exhaust unit 80 to exhaust the carbon dioxide gas and dirt remaining in the tub 30 to the outside. The exhaust part 80 may include an exhaust port 82 formed in the tub 30 and a blowing fan 81 to generate a pressure difference to flow the air.

However, in the present example embodiment, the washing medium is not limited to the dry ice snow, but may include, for example, and without limitation, liquid nitrogen whose vaporization point is lower than normal temperature. The liquefied nitrogen may be maintained in the liquefied state in the spraying nozzle 52, and then immediately vaporized as the liquefied nitrogen is sprayed from the spraying nozzle 52 toward the laundry.

Therefore, dirt such as stains, oil, and the like may be separated from the laundry by chemical reaction with materials stuck to the laundry during the vaporization and physical force of the liquid nitrogen colliding with the laundry surface.

Referring to FIGS. 1 to 3, a washing process by the washing machine according to the first example embodiment of the present disclosure having the above-described structure will be briefly described.

As illustrated in FIG. 1, the tub cover 32 of the washing machine 1 is opened by pivoting on the hinge shaft 33 (see, e.g., FIGS. 4 and 5) and the laundry L to be washed is laid out on the bottom screen 42.

As illustrated in FIG. 2, the tub cover 32 of the washing machine 1 is closed by pivoting on the hinge shaft 33. As a result, the top screen 41 provided on the tub cover 32 presses the laundry placed on the bottom screen 42 to further spread and fix the laundry, and prevents the dry ice snow sprayed from the dry ice spraying nozzle 52 from leaking out of the tub 30.

When the driving unit 60 is operated to drive the nozzle assembly 50 and at the same time, the dry ice snow is sprayed toward the laundry by the dry ice spraying nozzle 52, the dirt stuck to the laundry may be removed by physical and chemical action due to the spraying pressure and sublimation action of the dry ice snow.

The sublimated carbon dioxide and the removed dirt may remain in the air inside the tub 30 or may be discharged into the air outside the main body 10 by operating the exhaust unit 80.

As illustrated in FIG. 3, when the washing operation is completed, the tub cover 32 is opened by pivoting on the hinge shaft 33, and the laundry may be taken out.

Figure 6:
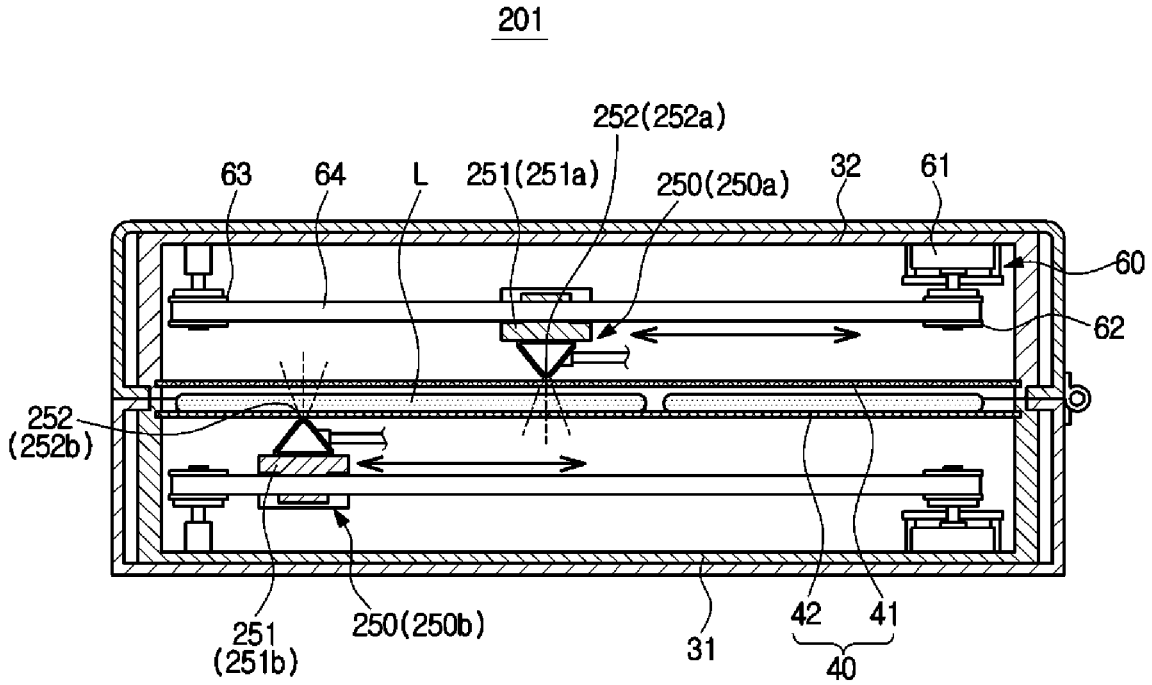
FIG. 6 is a diagram illustrating a part of an example washing machine with a structure in which an injection nozzle has an upper injection nozzle on the upper side of the screen and a lower injection nozzle on the lower side of the screen according to a second example embodiment of the present disclosure.

FIG. 6 is a diagram illustrating a part of an example washing machine according to a second example embodiment of the present disclosure, with a structure in which an injection nozzle has an upper injection nozzle on the upper side of the screen and a lower injection nozzle on the lower side of the screen.

Referring to FIG. 6, a washing machine 201 according to a second example embodiment of the present disclosure will be described. The same reference numerals are assigned to the same components as those in the above-described embodiment, and a repeated description thereof may be omitted.

A plurality of nozzle assemblies 250 may be provided. The nozzle assembly 250 may include an upper nozzle assembly 250*a* provided on the upper side of the screen 40 and a lower nozzle assembly 250*b* provided on the lower side of the screen 40.

The upper nozzle assembly 250*a* may include a nozzle body 251*a*, and a dry ice spraying nozzle 252*a* provided on the nozzle body 251*a* to spray dry ice snow toward the upper surface of the laundry L.

The lower nozzle assembly 250*b* may include a nozzle body 251*b*, and a dry ice spraying nozzle 252*b* provided on the nozzle body 251*b* to spray the dry ice snow toward the lower surface of the laundry.

The upper nozzle assembly 250*a* and the lower nozzle assembly 250*b* may be separately driven or may be driven together.

With the above-described structure, since the upper and lower surfaces of the laundry can be washed, the washing efficiency can be improved.

Figure 7:
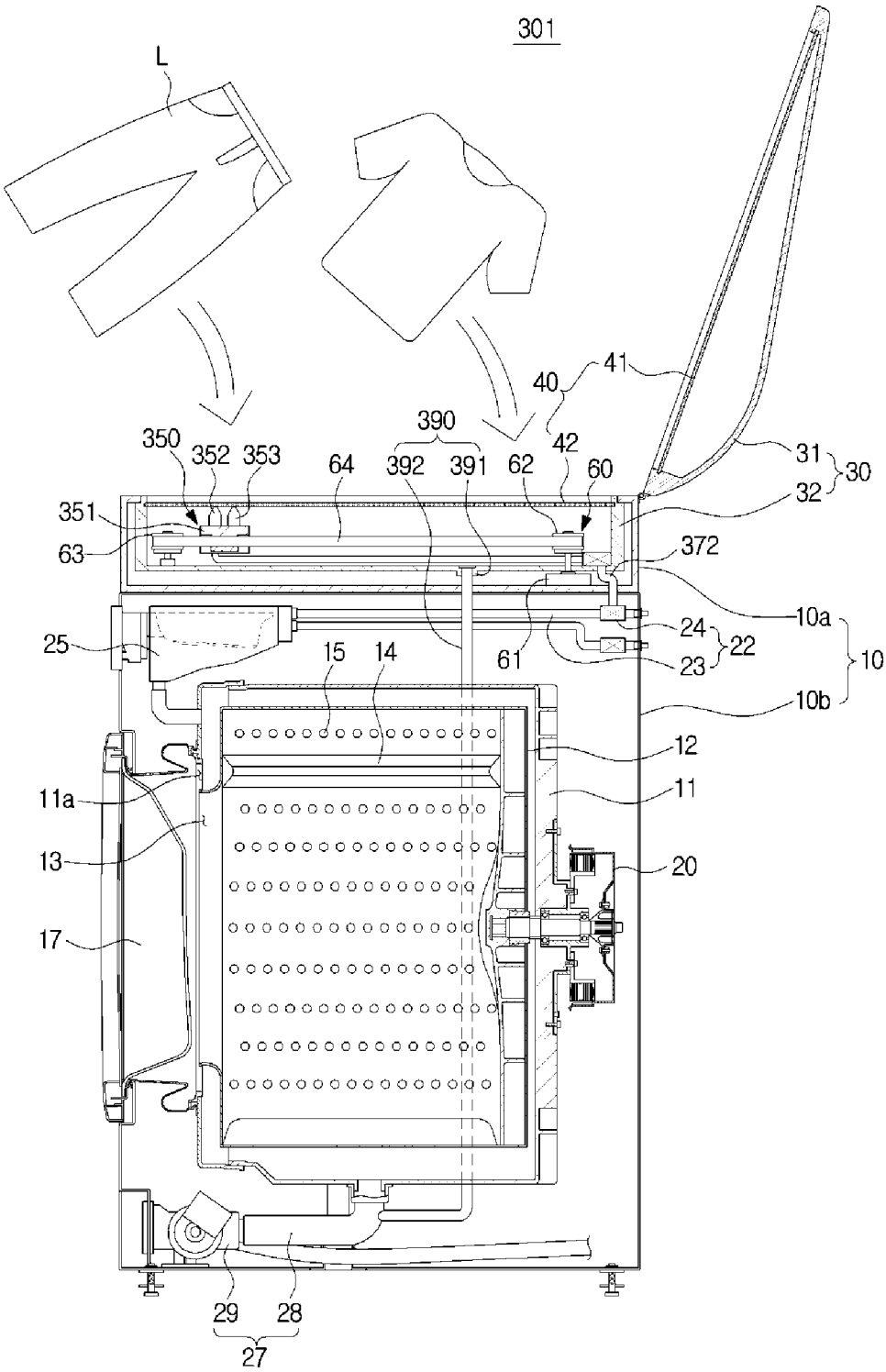
FIG. 7 is a diagram illustrating an example washing machine using washing water as a washing medium with laundry being thrown into the tub according to a third example embodiment of the present disclosure.
Figure 8:
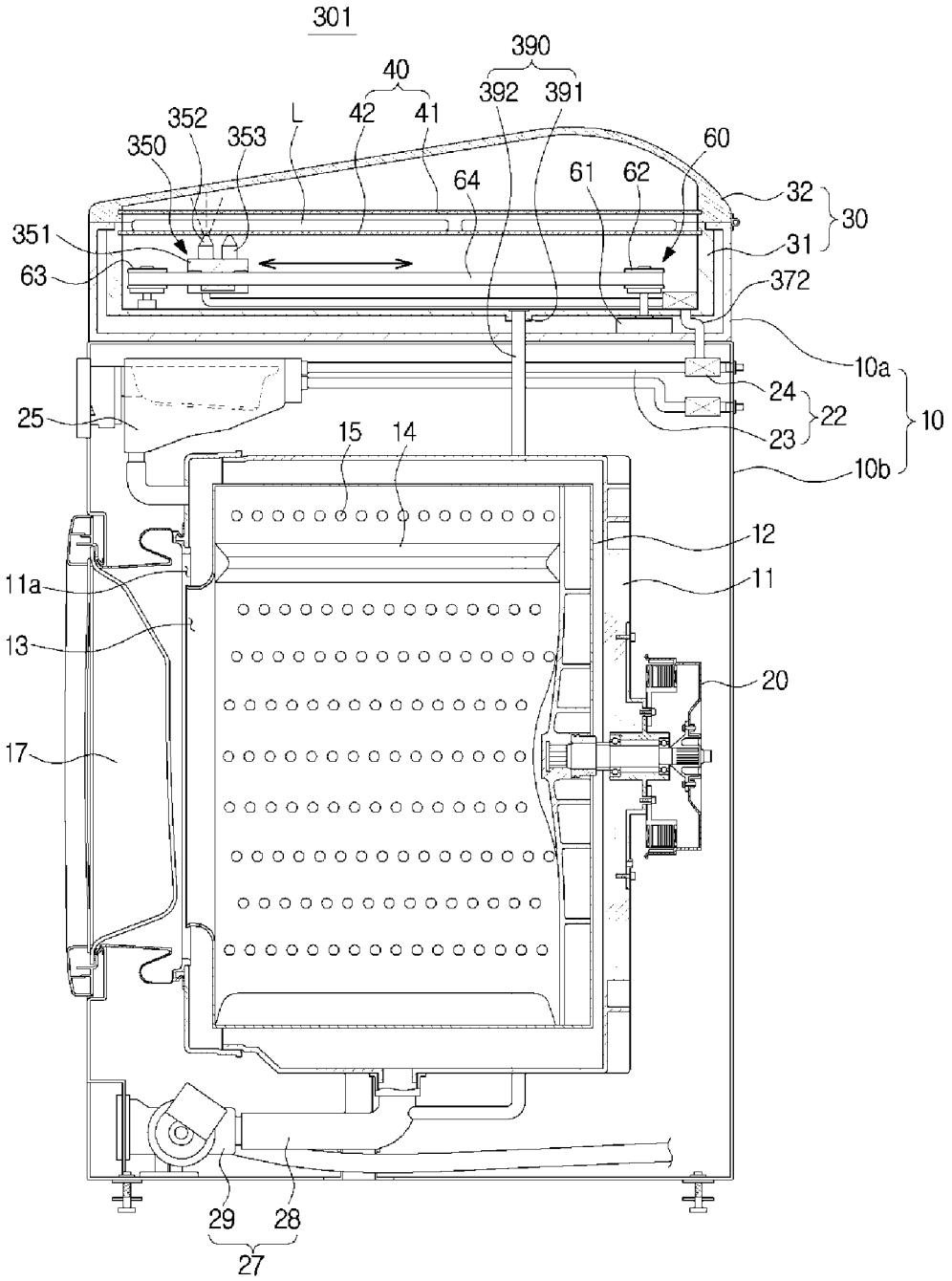
FIG. 8 is a diagram illustrating an example state in which a tub cover is closed after laundry is put into a tub of the washing machine of FIG. 7.
Figure 9:
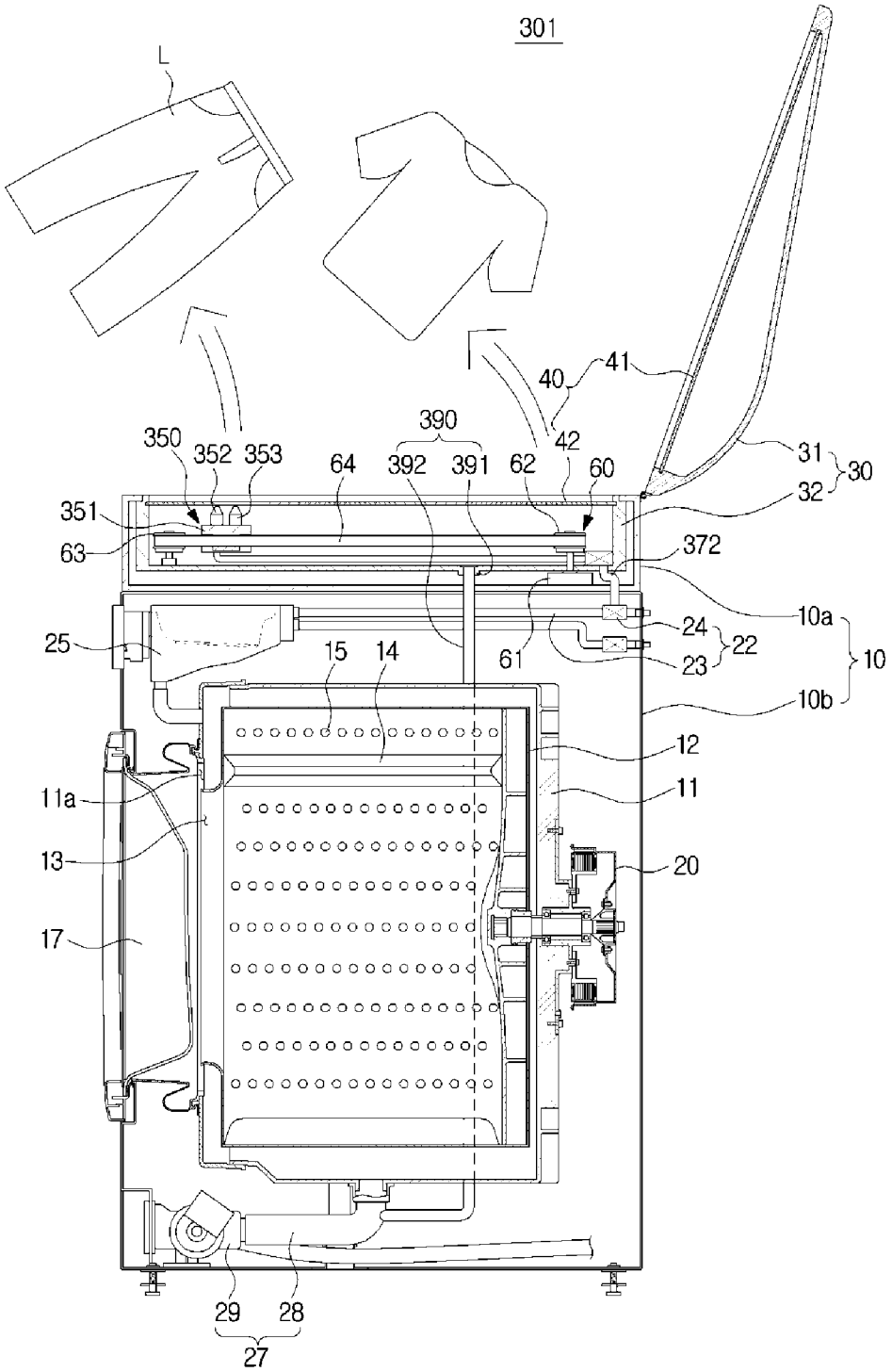
FIG. 9 is a diagram illustrating an example operation of taking laundry out after the washing machine of FIG. 7 finishes washing.
Figure 10:
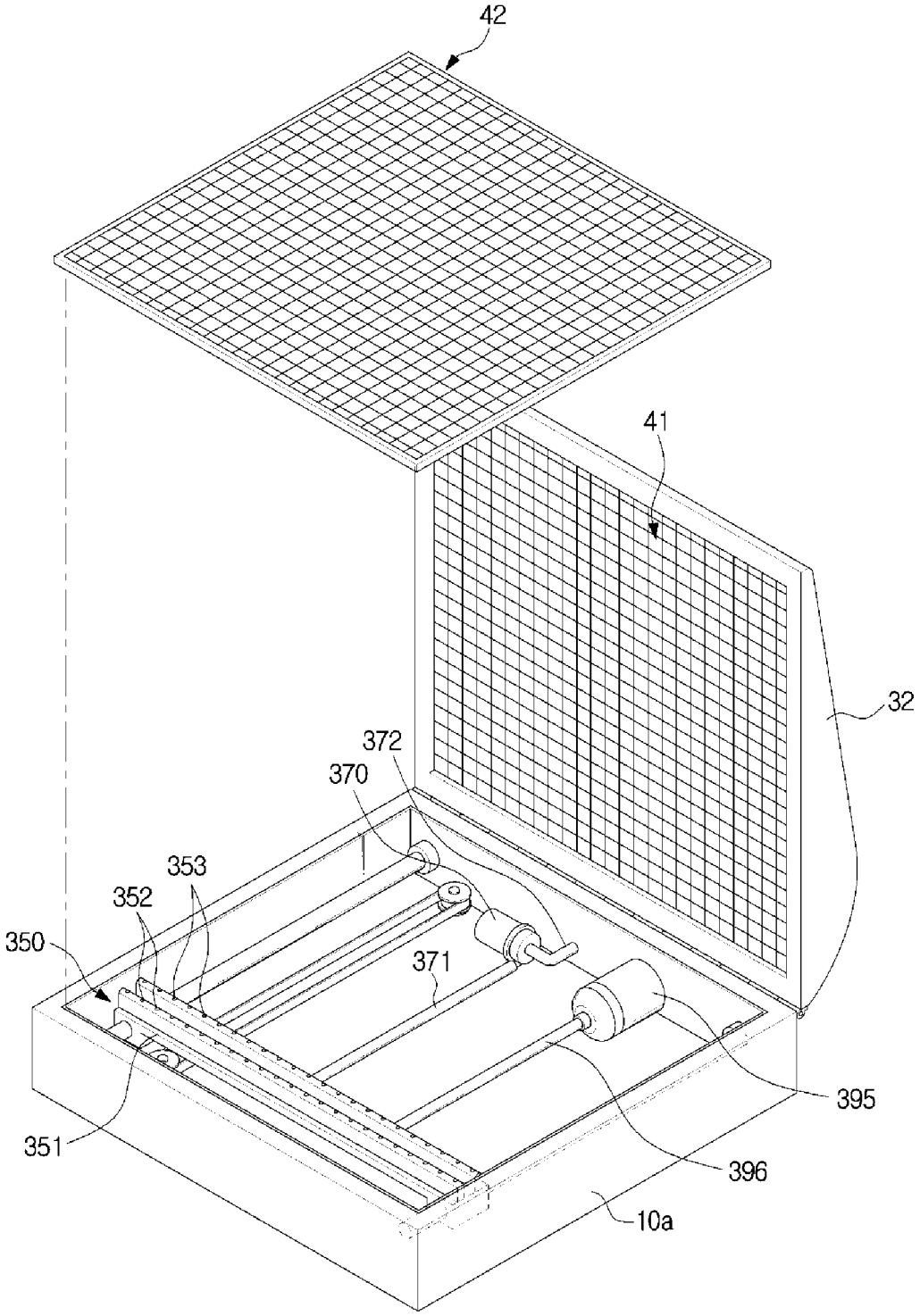
FIG. 10 is a perspective view illustrating an example configuration of the washing machine of FIG. 7.

FIG. 7 is a diagram illustrating an example washing machine using washing water as a washing medium according to a third example embodiment of the present disclosure, and illustrates an operation of putting laundry into a tub. FIG. 8 is a diagram illustrating a state in which a tub cover is closed after laundry is put into the tub of the washing machine of FIG. 7. FIG. 9 is a diagram illustrating an operation of taking laundry out after washing of the washing machine of FIG. 7. FIG. 10 is a perspective view illustrating an example configuration of the washing machine of FIG. 7.

Referring to FIGS. 7 to 10, a washing machine 301 according to a third example embodiment of the present disclosure will be described. The same reference numerals are assigned to the same components as those in the above-described embodiment, and a repeated description thereof may be omitted.

Although the dry ice snow is used as the washing medium in the above-described embodiment, the washing medium is not necessarily limited to the dry ice snow, but may be commonly used washing water.

In this case, the nozzle assembly 350 of the washing machine 301 may include a nozzle body 351 and a washing water spraying nozzle 352 provided in the nozzle body 351 to spray washing water.

The nozzle assembly 350 may be movably provided to evenly spray washing water over the entire laundry. The nozzle assembly 350 may be arranged to reciprocate linearly in a direction perpendicular to a direction in which the washing water spraying nozzles 352 are arranged.

The laundry is widely spread by the screen 40 and a plurality of the washing water spraying nozzles 352 are arranged along one direction and the nozzle assembly 350 is linearly moved in a direction orthogonal to the one direction. Therefore, the washing water may be sprayed evenly.

The nozzle assembly 350 may further include a hot air spraying nozzle 353 to spray hot air to dry laundry wet with the washing water.

The washing machine 301 may include a water pump 370 serving as a washing medium supplying unit to supply the washing medium to the nozzle assembly 350. The water pump 370 may pump the washing water supplied from the water supply pipe 372 and pump the washing water through the tube 371 to the wash water spraying nozzle 352.

The washing machine 301 may include a hot air supply unit 395 to supply hot air to the hot air spraying nozzle 353. The hot air supply unit 395 may include a heater (not shown) and a blower fan (not shown) to flow air. The hot air supply unit 395 may supply hot air to the hot air spraying nozzle 353 through the tube 396.

The washing machine 301 may include a drain unit 390 to drain washing water stored in the tub 30 to the outside. The drain unit 390 may include a drain hole 391 formed in the tub 30 and a drain pipe 392 connected to the drain hole 391.

Figure 11:
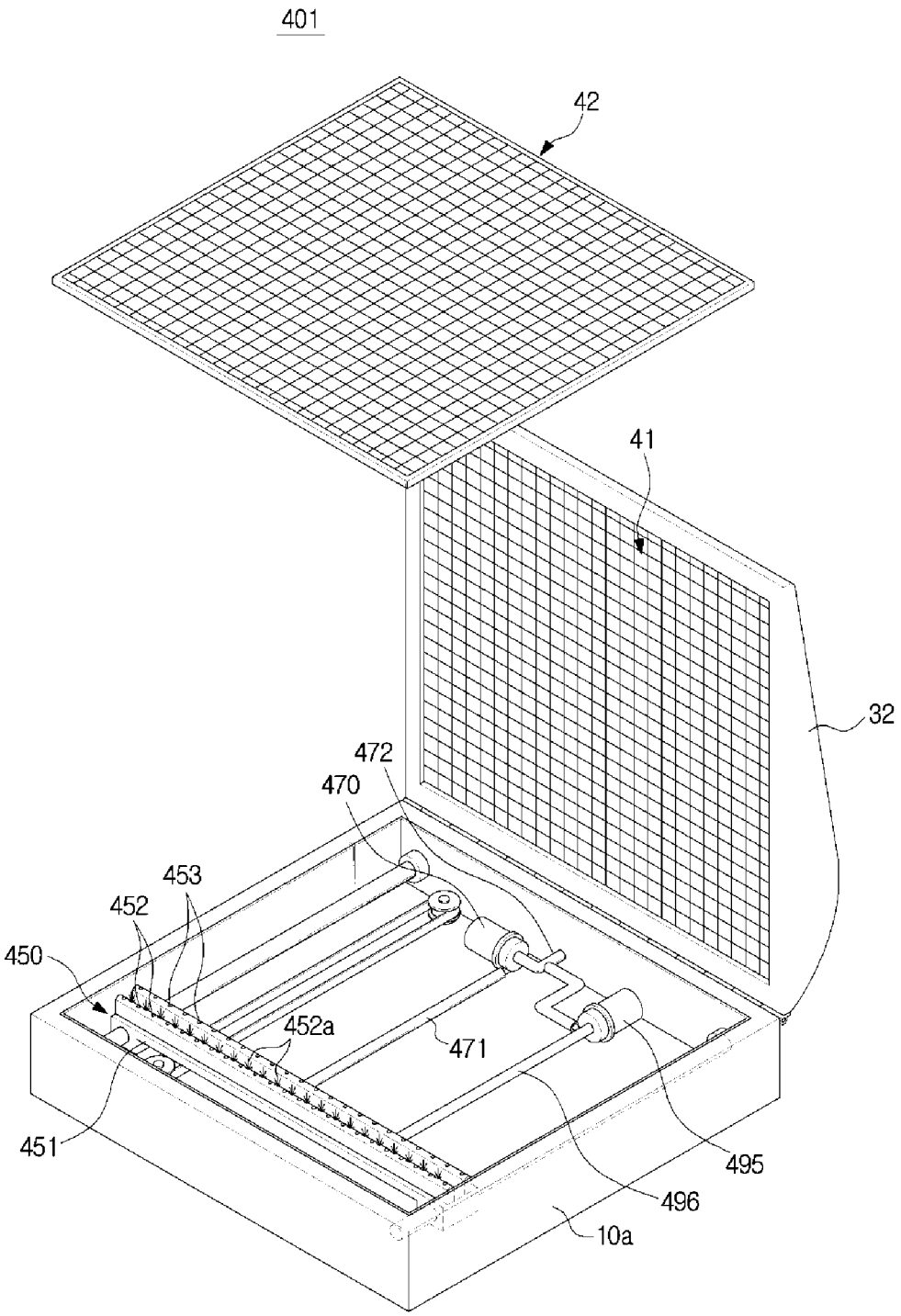
FIG. 11 is a diagram illustrating an example washing machine using ultrasonic waves as a washing medium according to a fourth example embodiment of the present disclosure.

FIG. 11 is a diagram illustrating an example washing machine using ultrasonic waves as a washing medium according to a fourth example embodiment of the present disclosure.

Referring to FIG. 11, a washing machine 401 according to a fourth example embodiment of the present disclosure will be described. The same reference numerals are assigned to the same components as those in the above-described embodiment, and a repeated description thereof may be omitted.

The washing machine 401 may use ultrasonic waves as a washing medium. For example, the nozzle assembly 450 of the washing machine 401 may include a nozzle body 451 and an ultrasonic spraying nozzle 452 provided on the nozzle body 451 to spray ultrasonic waves together with washing water. The ultrasonic spraying nozzle 452 may include a vibrator (not shown) that generates ultrasonic waves.

The nozzle assembly 450 may be movably provided to spray washing water and ultrasonic waves evenly over the entire laundry. The nozzle assembly 450 may be arranged to linearly reciprocate in a direction perpendicular to the direction in which the ultrasonic spraying nozzles 452 are arranged.

The laundry is widely spread by the screen 40 and the plurality of ultrasonic spraying nozzles 452 are arranged along one direction and the nozzle assembly 450 linearly moves in a direction orthogonal to the one direction. Therefore, ultrasonic waves and washing water may be sprayed uniformly to the entire laundry without missing parts.

The nozzle assembly 450 may include a cleaning brush 452*a*. The nozzle assembly 450 may further include a suction nozzle 453 to suck in the moisture of laundry to dry the laundry wet with the washing water.

The washing machine 401 may include a water pump 470, which is a washing medium supplying unit to supply a washing medium to the nozzle assembly 450. The water pump 470 may pump the washing water supplied from the water supply pipe 472 and pump the wash water through the tube 471 to the ultrasonic spraying nozzle 452.

The washing machine 401 may include a suction pump 495 to collect and recycle the water sucked through the suction nozzle 454. The suction pump 495 may circulate the sucked water to the water supply pipe 472 through the recovery pipe 496, thereby making it possible to recycle the water as a washing medium.

Figure 12:
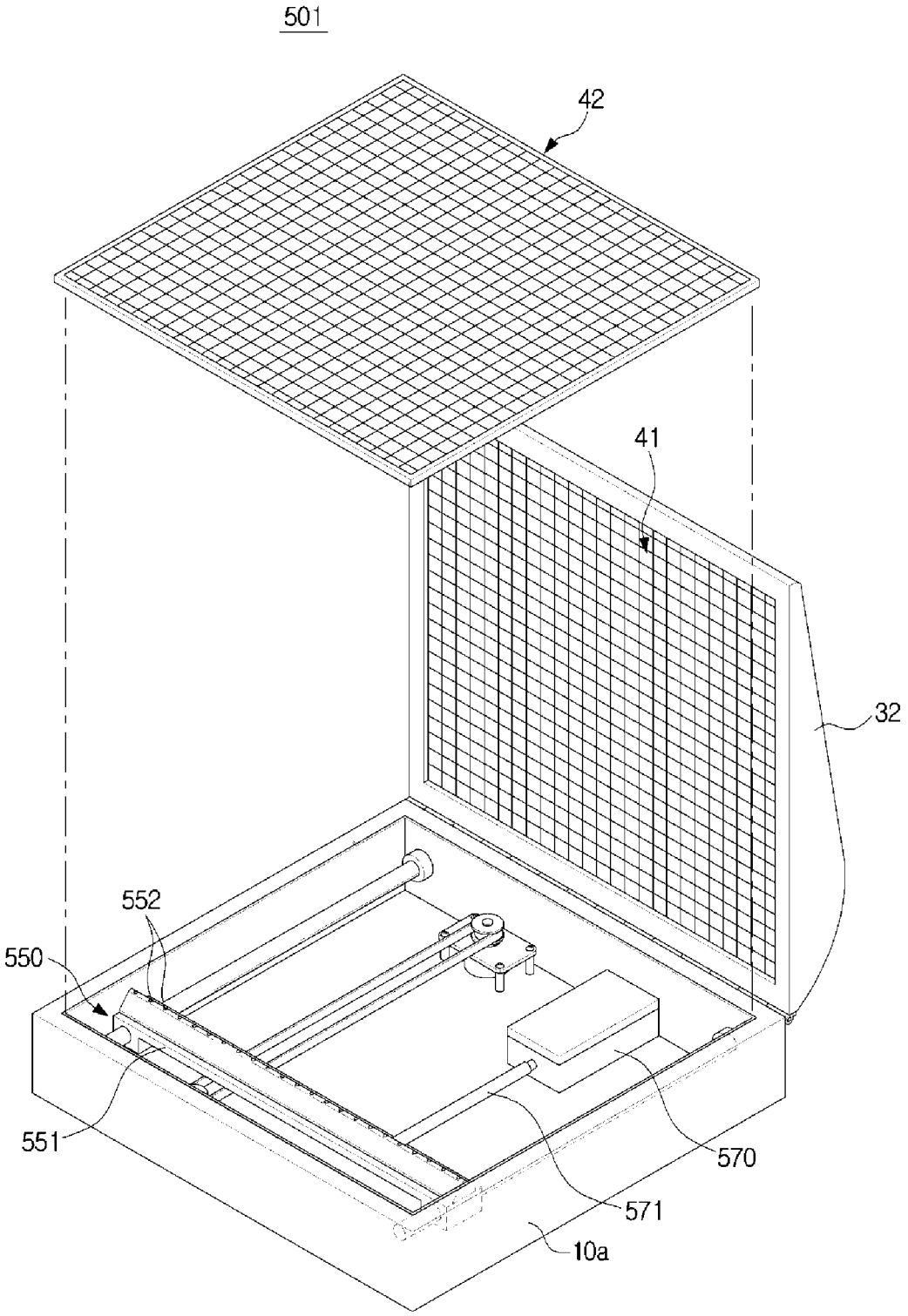
FIG. 12 is a diagram illustrating an example washing machine using steam as a washing medium according to a fifth example embodiment of the present disclosure.

FIG. 12 is a diagram illustrating an example washing machine using steam as a washing medium according to a fifth example embodiment of the present disclosure.

Referring to FIG. 12, a washing machine 501 according to a fifth example embodiment of the present disclosure will be described. The same reference numerals are assigned to the same components as those in the above-described embodiment, and a repeated description thereof may be omitted.

The washing machine 501 may use steam, that is, heated steam, as the washing medium. The nozzle assembly 550 of the washing machine 501 may include a nozzle body 551 and a steam spraying nozzle 552 provided in the nozzle body 551 to spray the steam The nozzle assembly 550 may be movably provided to spray steam evenly over the laundry. The nozzle assembly 550 may be arranged to linearly reciprocate in a direction perpendicular to the direction in which the washing water spraying nozzles 552 are arranged.

The laundry is widely spread by the screen 40 and the plurality of steam spraying nozzles 552 are arranged along one direction and the nozzle assembly 550 linearly moves in a direction orthogonal to the one direction. Therefore, steam may be sprayed evenly into the entire laundry without missing parts.

The washing machine 501 may include a steam generator 570, which is a washing medium supplying unit to supply a washing medium to the nozzle assembly 550. The steam generated in the steam generator 570 may be guided to the steam spraying nozzle 552 through the tube 571.

Figure 13:
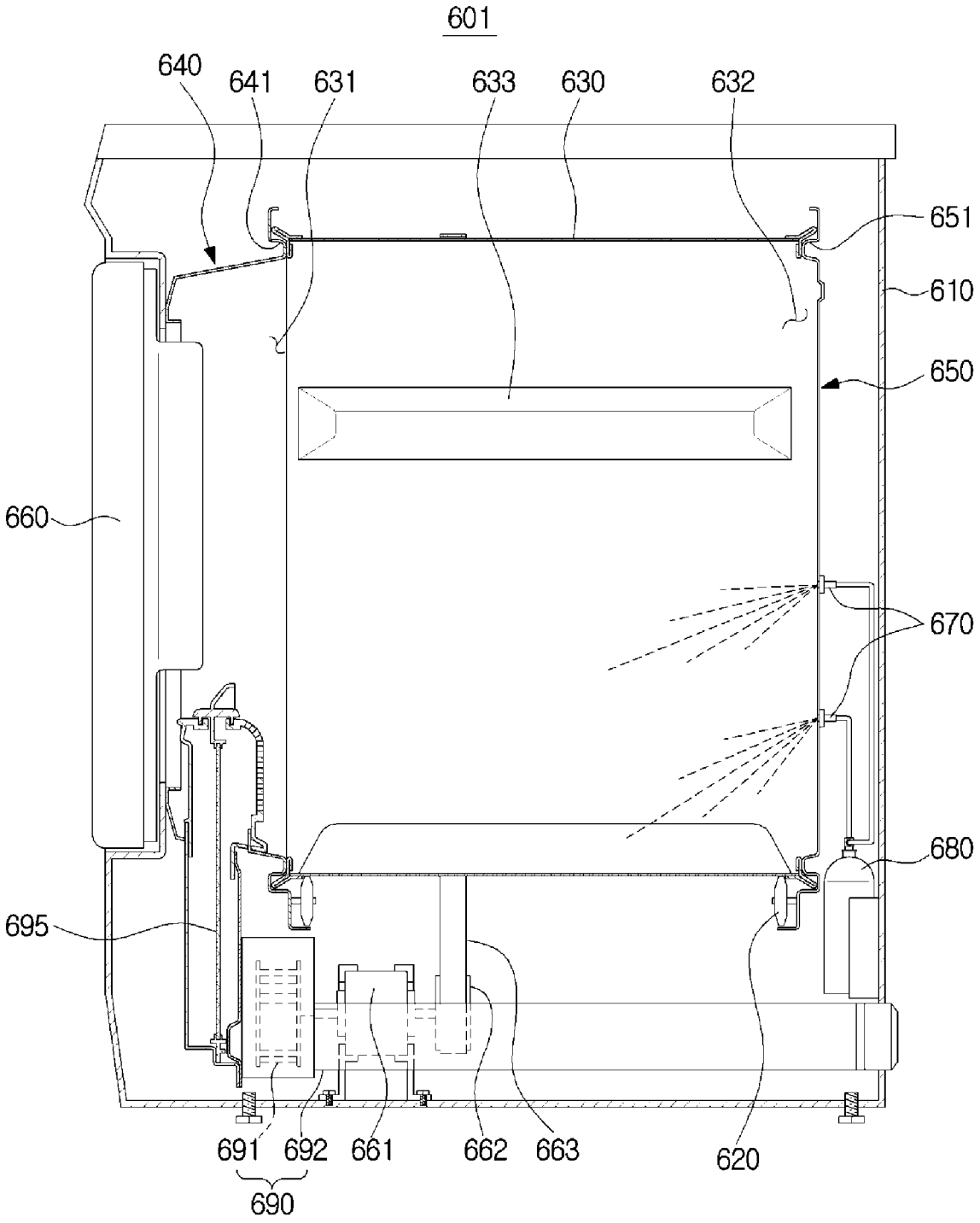
FIG. 13 is a diagram illustrating an example drum-type washing machine using dry ice snow as a washing medium according to a sixth example embodiment of the present disclosure.
Figure 14:
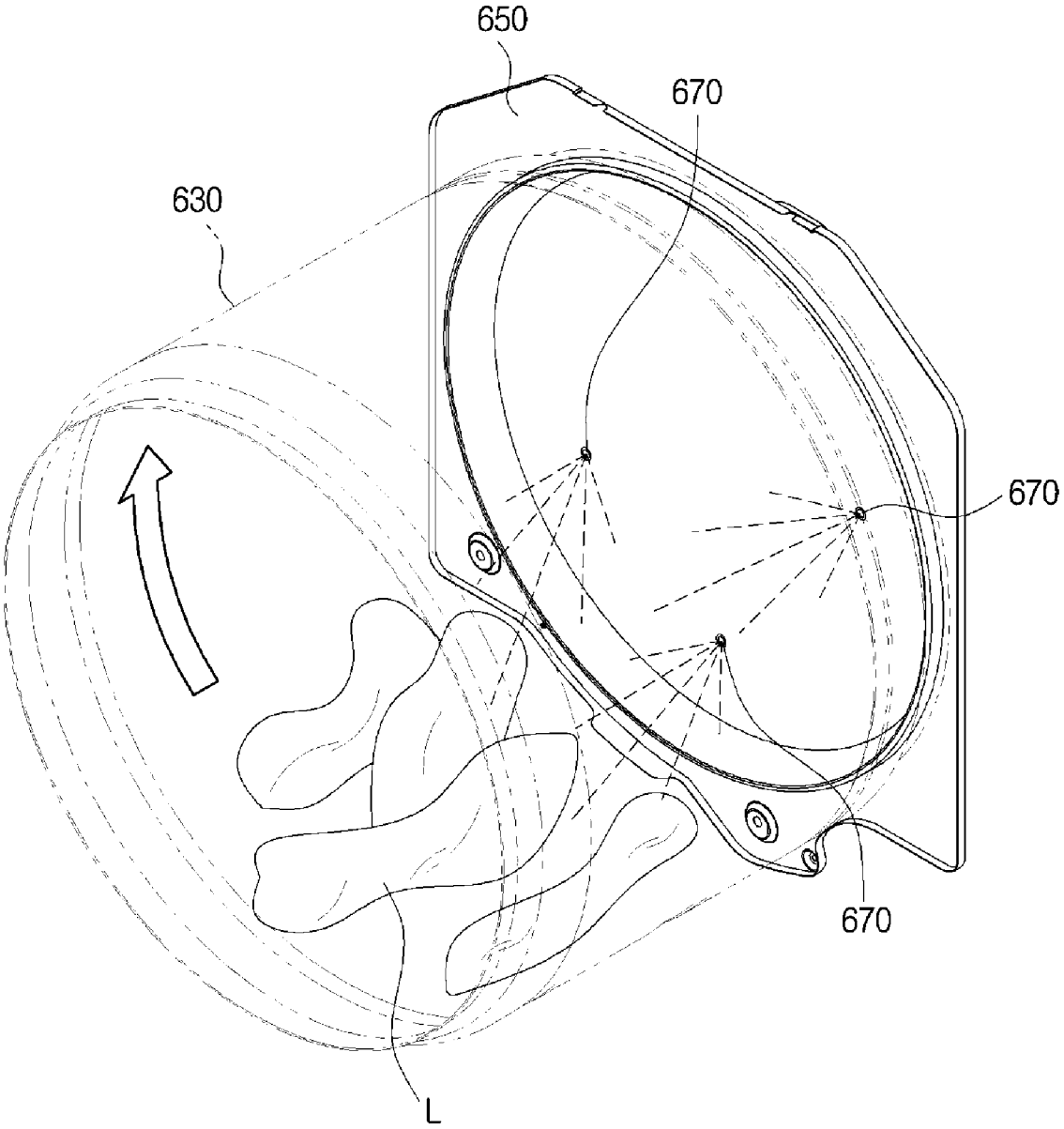
FIG. 14 is a diagram illustrating an example injection structure of an injection nozzle of the washing machine of FIG. 13.

FIG. 13 is a diagram illustrating an example drum type washing machine using dry ice snow as a washing medium according to a sixth example embodiment of the present disclosure. FIG. 14 is a diagram illustrating an example injection structure of an injection nozzle of the washing machine of FIG. 13.

Referring to FIG. 13, a washing machine 601 according to a sixth example embodiment of the present disclosure will be described. The same reference numerals are assigned to the same components as those in the above-described embodiment, and a repeated description thereof may be omitted.

The present example embodiment relates to a structure for effectively performing washing by using dry ice snow as a washing medium in a washing machine not of a scanner type as described above but of a typically used drum type. The washing machine 601 may include a main body, a drum 630 rotatably provided in the main body, and a spraying nozzle 670 to spray dry ice snow onto laundry contained in the drum 630.

The drum 630 has a substantially cylindrical shape and may be formed so that the front surface 631 and the rear surface 632 are opened. A front plate 640 may be provided on the front surface 631 of the drum 630 and a back plate 650 may be provided on the rear surface 632 of the drum 630 to support the drum 630 to be rotatable.

The front plate 640 and the back plate 650 are fixed regardless of rotation of the drum 630 and include a front support portion 641 to support the front end portion of the drum 630 and a rear support portion 651 to support a rear end portion of the drum 630, respectively.

A roller 620 may be provided at a lower portion of the drum 630 to support the drum 630 to rotate smoothly. The inner surface of the drum 630 may be provided with a lifter 633 to lift and stir the laundry.

The washing machine 601 may include a driving unit to drive the drum 630. The driving unit includes a motor 661, a pulley 662 connected to the motor 661 and rotated, and a belt 663 which is wound around the pulleys 662 and the drum 630 to transfer the rotational force of the pulley 662 to the drum 630.

An opening is formed in the front plate 640, and the laundry may be put into the drum 630 through the opening of the front plate 640. The opening of the front plate 640 may be opened and closed by the door 660.

The spraying nozzle 670 may receive carbon dioxide from the carbon dioxide supply unit 680 and spray dry ice snow toward the laundry. A plurality of spraying nozzles 670 may be provided and spray directions of the respective spraying nozzles 670 may be different from each other so that dry ice snow may be uniformly sprayed on the entire laundry in the drum 630. The spraying nozzle 670 may be provided, for example, and without limitation, on the back plate 650.

The washing machine 601 may include an exhaust unit 690 to exhaust the carbon dioxide sublimated inside the drum 630 and the dirt removed from the laundry to the outside of the drum 630. The exhaust unit 690 may include a blowing fan 691 to form an airflow by receiving rotational force from the motor 661, a guide duct 692, and a filter 695 formed inside the guide duct 692 to filter foreign substances such as lint.

This drum-type structure allows a large amount of laundry to be efficiently washed using dry ice snow as a washing medium as compared with the scanner-type washing machine as described above.

According to an example aspect of the present disclosure, a washing machine may effectively perform anhydrous washing using, for example, and without limitation, dry ice snow or liquefied nitrogen as a washing medium.

According to an example aspect of the present disclosure, washing may be carried out simply and conveniently using a scanner-type washing machine.

Although various example embodiments of the present disclosure have been illustrated and described, it will be appreciated by those skilled in the art that changes may be made in these embodiments without departing from the principles and spirit of the disclosure, the scope of which is defined in the claims and their equivalents.

What is claimed is:

1. A washing machine comprising:

a tub;

a substantially flat screen provided inside the tub and configured to support laundry;

a nozzle assembly comprising a plurality of washing medium spraying nozzles configured to spray washing medium toward the laundry, the nozzle assembly being movable;

a driver configured to move the nozzle assembly; and a washing medium supply configured to supply the washing medium to the nozzle assembly.

2. The washing machine according to claim 1, wherein the screen comprises a mesh configured to allow the washing medium to pass through.

3. The washing machine according to claim 1, wherein the screen comprises a bottom screen and a top screen, wherein the screen is configured to receive and fix the laundry between the bottom screen and the top screen.

4. The washing machine according to claim 3, wherein the top screen is configured to pivot on a hinge axis to enable placement and/or removal of the laundry from between the bottom screen and the top screen.

5. The washing machine according to claim 1, wherein the nozzle assembly is configured to reciprocate linearly.

6. The washing machine according to claim 1, wherein the plurality of washing medium spraying nozzles are arranged along a first direction, and the nozzle assembly is configured to be movable along a second direction orthogonal to the first direction.

7. The washing machine according to claim 1, wherein the washing medium spaying nozzle comprises an upper spraying nozzle disposed on an upper side of the screen and a lower spraying nozzle disposed on a lower side of the screen.

8. The washing machine according to claim 1, wherein the washing medium comprises carbon dioxide in snow phase.

9. The washing machine according to claim 1, wherein the washing medium comprises liquid nitrogen.

10. The washing machine according to claim 1, wherein the washing medium comprises washing water and/or steam.

11. The washing machine according to claim 10, wherein the nozzle assembly further comprises a hot air spraying nozzle configured to spray hot air toward the laundry.

12. The washing machine according to claim 10, wherein the nozzle assembly further comprises a suction nozzle configured to suck in moisture from the laundry.

13. The washing machine according to claim 10, further comprising:

a drain configured to drain washing water stored in the tub.

14. The washing machine according to claim 1, wherein the washing medium comprises ultrasonic waves.

15. The washing machine according to claim 1, further comprising:

another tub provided under the tub and a drum rotatably installed in the another tub and configured to receive the laundry.

* * * * *